US009447583B2

(12) United States Patent
Tovmasyan

(10) Patent No.: US 9,447,583 B2
(45) Date of Patent: Sep. 20, 2016

(54) DORMER ROOF VENT

(71) Applicant: Gurgen Tovmasyan, Los Angeles, CA (US)

(72) Inventor: Gurgen Tovmasyan, Los Angeles, CA (US)

(73) Assignee: ABLE SHEET METAL, INC., Los Angeles, CA (US)

( * ) Notice: Subject to any disclaimer, the term of this patent is extended or adjusted under 35 U.S.C. 154(b) by 356 days.

(21) Appl. No.: 13/954,597

(22) Filed: Jul. 30, 2013

(65) Prior Publication Data

US 2014/0065946 A1 Mar. 6, 2014

Related U.S. Application Data

(60) Provisional application No. 61/695,971, filed on Aug. 31, 2012.

(51) Int. Cl.

| | |
|---|---|
| ***F24F 7/00*** | (2006.01) |
| ***E04D 13/17*** | (2006.01) |
| *F24F 7/02* | (2006.01) |
| *E04D 1/30* | (2006.01) |

(52) U.S. Cl.
CPC ..... *E04D 13/17* (2013.01); *E04D 2001/309* (2013.01); *F24F 7/02* (2013.01)

(58) Field of Classification Search
CPC ..... F24F 7/02; E04D 13/17
See application file for complete search history.

(56) References Cited

U.S. PATENT DOCUMENTS 1,606,410 A * 11/1926 Frame ..... B60H 1/262 454/136
2,300,842 A * 11/1942 Leslie ..... E04D 13/17 454/361
2,363,879 A * 11/1944 Leslie ..... F24F 7/02 454/242
2,382,076 A * 8/1945 Leslie ..... F24F 7/02 454/242
2,470,201 A * 5/1949 Werner ..... F24F 7/02 454/275
2,490,220 A * 12/1949 Leslie ..... E04D 13/03 454/366
2,551,965 A * 5/1951 Petersen ..... F24F 7/02 236/49.5
2,692,548 A * 10/1954 Knorr ..... F24F 7/02 454/366
2,973,704 A * 3/1961 Flanagan ..... E04D 13/03 454/366
3,083,633 A * 4/1963 Hochberg ..... F24F 7/02 454/366
4,184,414 A * 1/1980 Jarnot ..... F24F 7/02 454/275
4,297,818 A * 11/1981 Anderson ..... F24F 7/02 454/366
4,537,119 A * 8/1985 Jarnot ..... F24F 7/00 454/275
4,545,291 A * 10/1985 Kutsch ..... A01K 1/0058 454/365
4,592,269 A * 6/1986 Lamparter ..... B60H 1/248 454/115
4,625,630 A * 12/1986 Carroll ..... B65D 88/741 403/241
4,848,653 A * 7/1989 Van Becelaere ..... F24F 7/02 236/101 D
4,890,546 A * 1/1990 Venge ..... F24F 7/025 454/242

(Continued)

FOREIGN PATENT DOCUMENTS

GB 2199860 A 7/1988

*Primary Examiner* — Steven B McAllister
*Assistant Examiner* — Jonathan Cotov
(74) *Attorney, Agent, or Firm* — Koppel, Patrick, Heybl & Philpott

(57) ABSTRACT

A roof vent is provided comprising a base with an opening for air inlet/outlet, wherein the base opening may have raised venting edges. The base is connected to a cover over the base opening including at least one louver for air flow and a front opening. Sloped side walls connect the base and cover. The front edge of the top of the cover has a lip angled down over the front opening. The lip reduces leakage into the vent. A mesh grill or cover can be included in the front opening. A rectangular strip with drainage holes can be included at the bottom of the front opening, to secure the mesh grill in place. The rectangular strip can include drainage holes. Shingles can be placed on the cover so the vent blends in with the roof.

16 Claims, 2 Drawing Sheets

(56) References Cited

U.S. PATENT DOCUMENTS 5,394,663 A * 3/1995 Jackson ..... F24F 7/02 285/43
5,402,611 A * 4/1995 Vagedes ..... F24F 7/02 454/366
5,591,080 A * 1/1997 Ward ..... F24F 7/02 454/359
5,630,752 A * 5/1997 Gubash ..... E04D 1/30 454/366
5,662,522 A * 9/1997 Waltz ..... F24F 7/02 454/359
5,791,985 A * 8/1998 Schiedegger ..... F24F 7/02 454/339
6,129,628 A * 10/2000 O'Hagin ..... F24F 7/02 454/366
6,183,360 B1 * 2/2001 Luter, II ..... F24F 7/02 454/366
6,293,862 B1 * 9/2001 Jafine ..... F24F 7/02 454/359
6,733,381 B1 * 5/2004 Ploeger ..... F24F 13/082 454/366
D549,316 S * 8/2007 O'Hagin ..... D23/393
7,618,310 B2 11/2009 Daniels
D612,040 S * 3/2010 Daniels ..... D23/373
D618,780 S * 6/2010 Williams, Sr. ..... D23/373
D624,171 S * 9/2010 Irmer ..... D23/373
D625,800 S * 10/2010 Daniels ..... D23/373
8,205,401 B2 * 6/2012 Ward ..... F24F 7/02 454/367
9,243,813 B2 * 1/2016 Mantyla ..... F24F 7/02
2004/0002297 A1 * 1/2004 Pfleiderer ..... F24F 7/02 454/16
2005/0148295 A1 * 7/2005 Koessler ..... F24F 7/02 454/353
2005/0233691 A1 * 10/2005 Horton ..... F24F 7/02 454/366
2006/0121845 A1 * 6/2006 Sells ..... F24F 7/02 454/365
2006/0223437 A1 * 10/2006 O'Hagin ..... F24F 7/02 454/366
2006/0240762 A1 * 10/2006 Railkar ..... F24F 7/02 454/260
2007/0049190 A1 * 3/2007 Singh ..... E04D 13/17 454/365
2007/0173191 A1 * 7/2007 Daniels ..... F24F 7/02 454/250
2009/0113823 A1 * 5/2009 Osborne ..... F24F 7/02 52/198
2010/0184366 A1 * 7/2010 Hassenstab ..... F24F 13/20 454/367
2010/0257798 A1 * 10/2010 Ward ..... F24F 7/02 52/301
2011/0294412 A1 * 12/2011 Vagedes ..... F24F 7/02 454/242

* cited by examiner

FIG. 1
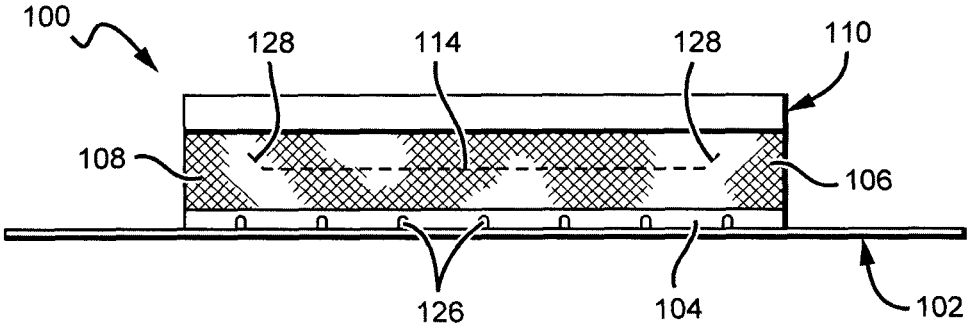
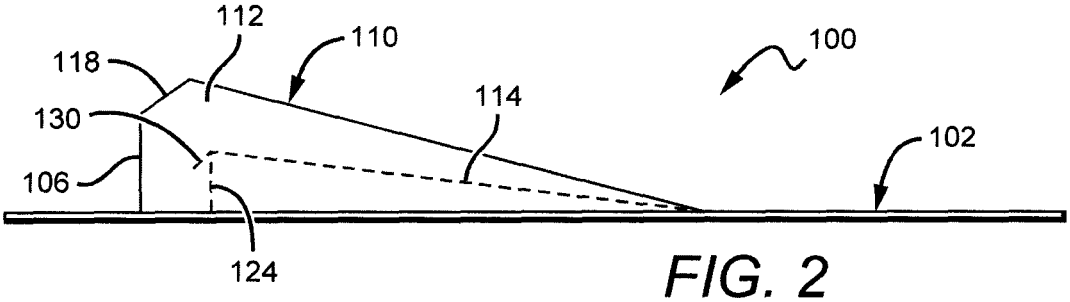
FIG. 2
FIG. 3
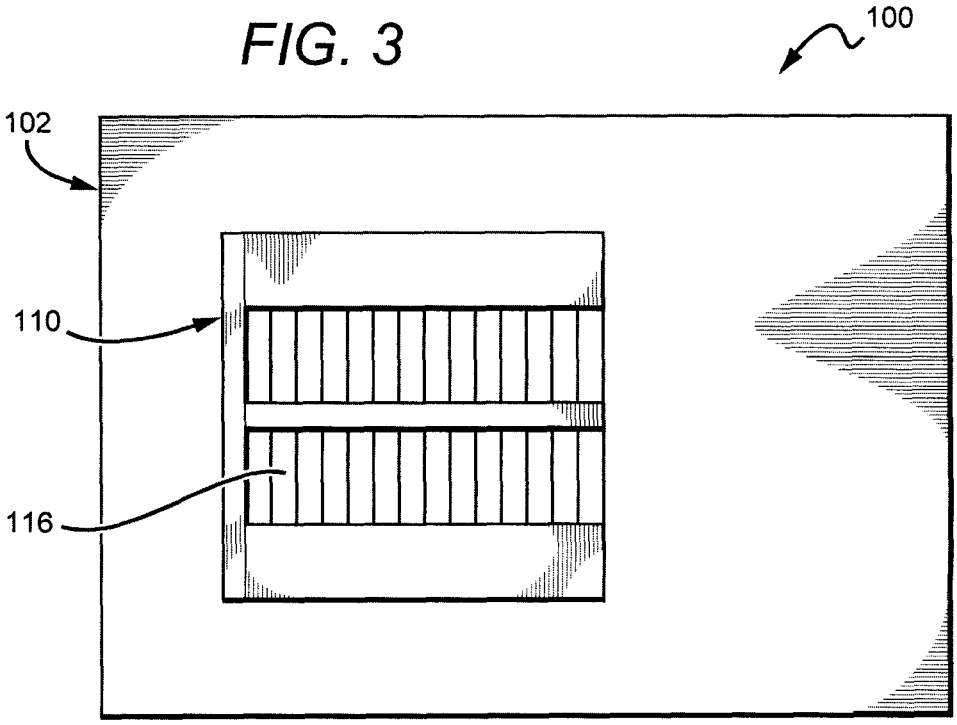

DORMER ROOF VENT

This application claims the benefit of U.S. Provisional Patent Application No. 61/695,971, entitled "Dormer Roof Vent", filed on Aug. 31, 2012.

BACKGROUND OF THE INVENTION

1. Field of the Invention

This invention pertains to a roof vent, such as for venting a roof or attic of a building.

2. Description of the Related Art

Roof vents provide the necessary ventilation to the roof or attic of a house or other building or structure, supporting ventilation of the roof, attic, or other area of the building. In some cases this improves conditions, pressure or temperatures in the structure, in others it prevents condensation in the roof. Various roof vents employ vanes, grates and louvers to permit air to be channeled between the roof and the atmosphere, and to try to prevent rain from entering the roof through the roof vent. A variety of caps and covers have been used to act as a guard to prevent the infiltration of rain. Roof vents are most often used for equalizing the pressure and/or the temperature between the interior and the exterior of a building. To do this, the vent provides a passage for air to flow out of a house, building, warehouse, attic or otherwise unventilated room or area to the outside and vice versa. A desirable roof vent also inhibits liquid and solid contaminants, particularly water, traversing through the openings, which allow the air to flow.

SUMMARY OF THE INVENTION

The present application is directed towards a roof vent. This roof vent may be designed to be structurally sound to withstand the elements, with a return angle on the lip and guided water drainage from the louvers to prevent leakage or contaminant entrance while allowing maximum air flow. Intended for use on roofs.

One embodiment of the present disclosure describes a roof vent comprising a base with a base opening. The roof vent also includes a cover over the base opening. The cover is connected to the base by sloped side walls and the cover includes at least one louver. The roof vent also includes an interior plate positioned between the base opening and the cover.

Another embodiment of the present disclosure describes a roof vent, comprising a base with a base opening. The base includes raised features along the base opening to reduce liquid flow from the base through base opening. The vent also includes a cover over the base opening. The cover is connected to the base by sloped side walls. The cover includes at least one louver positioned at least in part over the base opening, wherein the base, the cover and the side walls are positioned such that a front opening is created. The vent further includes an interior plate positioned between the base opening and the cover, the interior plate includes flow features to guide liquid flow toward the front opening.

These and other aspects and advantages of the invention will become apparent from the following detailed description and the accompanying drawings, which illustrate by way of example the features of the invention.

BRIEF DESCRIPTION OF THE DRAWINGS

FIG. 1 shows a front view of an embodiment of the roof vent;

FIG. 2 shows a side view of an embodiment of the roof vent;

FIG. 3 shows a top view of an embodiment of the roof vent;

DETAILED DESCRIPTION OF THE INVENTION

The present disclosure is directed to roof vent components, and systems using such components, having features which prevent debris or liquids from entering through the vent. These vents may be placed anywhere on a roof including on a dormer or separated areas.

The invention is described herein with reference to certain embodiments and configurations, but it is understood that the invention can be embodied in many different forms and should not be construed as limited to the embodiments or configurations set forth herein. In particular, embodiments of the present invention are described below in regards to dormer roof vents, but it is understood that it is applicable to many other vent styles, types and applications.

It is understood that when an element is referred to as being "on" another element, it can be directly on the other element or intervening elements may also be present. Furthermore, relative terms, such as "inner", "outer", "upper", "above", "lower", "beneath", and "below", and similar terms, may be used herein to describe a relationship of one element to another. It is understood that these terms are intended to encompass different orientations of the device, in addition to the orientation depicted in the figures. Furthermore, the term "contact" or "connect" may refer to directly contacting/connecting or with intervening elements.

Although the terms primary, secondary, etc., may be used herein to describe various features, elements, components, regions and/or sections, these elements, components, regions, and/or sections should not be limited by these terms. These terms are only used to distinguish one element, component, region, or section from another. Thus, unless expressly stated otherwise, a primary feature, element, component, region, or section discussed below could be termed a secondary feature, element, component, region, or section without departing from the teachings of the present invention.

Embodiments of the invention are described herein with reference to view illustrations. The actual thickness, angles or orientations of the elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region or feature of an embodiment and are not intended to limit the scope of the invention.

Figure 4:
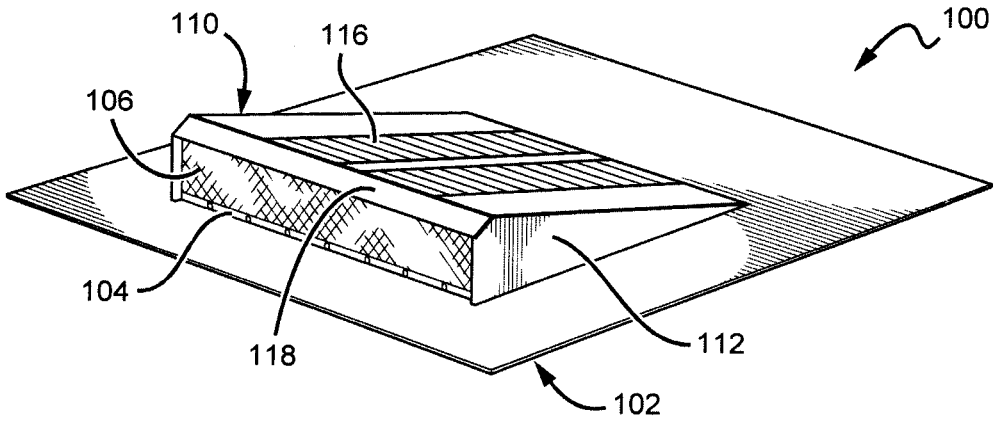
FIG. 4 shows a perspective view of an embodiment of the roof vent.
Figure 5:
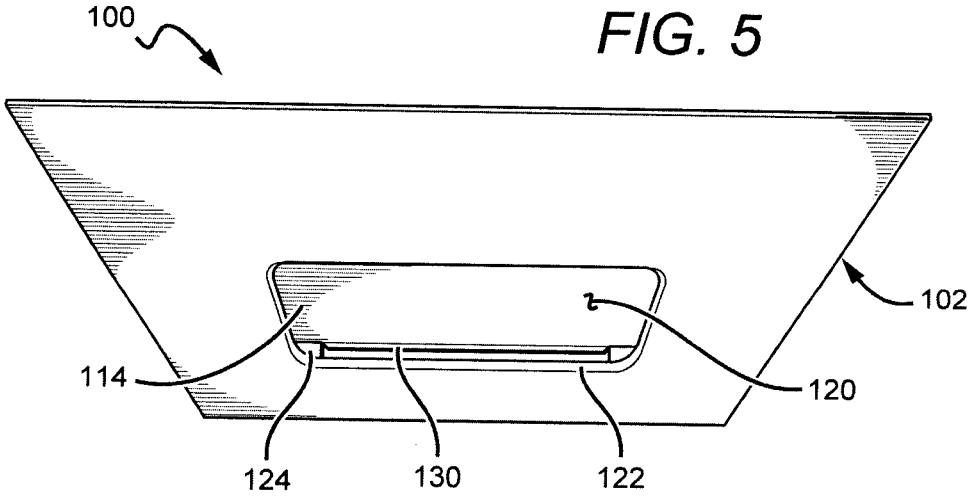
FIG. 5 shows a bottom perspective view of an embodiment of the roof vent.

FIGS. 1-5 show various views of some embodiments of the roof vent according to the present disclosure. As shown in FIG. 5, a perspective bottom view, in one embodiment of the present disclosure, the roof vent 100 comprises a base 102 with an opening 120 for air inlet/outlet, wherein said base opening has raised edges 122. The base 102 is at least in part connected to a cover 110 (FIG. 4) over the base opening 120. This cover 110, includes at least one exterior louver 116 for air flow, as shown in FIGS. 3 and 4, top and perspective views respectively. Though two adjacent sets of louvers 116 are shown in these figures, it should be understood that any number may be used and may be placed in any configuration on the top of cover 110. A front opening 106 is created between the cover 110 and the base 102. Sloped side walls 112 connect the base 102 and cover 110. Furthermore, in some embodiments, the front edge of the top of the cover 110 has a lip 118 curving over the front opening 106, as shown in FIGS. 2 and 4, side and perspective views respectively. The edge or lip 118 may extend past any covering over the front opening 106.

In other embodiments, as shown in FIGS. 1 and 4, the vent 100 can also utilize a front cover 108 over the front opening 106. Such a front cover 108 would allow for air flow while restricting debris. In one such embodiment the front cover 108 is a wire mesh over the front opening to regulate air flow and reduce debris which may enter the vent. The wire mesh 108 can contact the base or a rectangular strip running across the base from one sloped side wall to the other sloped side wall. The front cover 108 can cover the entirety of the opening 106 or just a portion.

In other embodiments, an interior piece or plate 114 can be included between the cover 110 and the base opening to help reduce leakage. The interior piece 110 may be located directly below the louver(s) 116 and may be at least slightly wider than the exterior louver(s) 116. The side edges of the interior piece 114 may include a bent lip 128 to help direct the flow of water or moisture that enters this area, this lip 128 shown in FIG. 1, located on at least the sides of the plate 114 nearest the side wall 112 portions (FIG. 2). As seen, FIG. 1 shows the plate 114 in dotted line. These side bent lip 128 portions prevent water from running off the sides of the plate 114.

In some embodiments, the interior piece 114 may be sloped, similarly to the cover 110, such that the plate 114 is higher near the front opening 106 and lower down to end where the cover 110 meets the base 102. This allows any water that enters, or moisture formed on the plate 114, through the cover's 110 louvers to drain toward and out of the roof vent base 102 through the front opening 106 minimizing leakage through the base opening 120. The front edge of the interior piece 114 closest to the front opening may also have a bent front lip 130 to help guide the flow of water out. This front lip 130 is bent in a direction opposite of that of the side lip 128 of the plate 114. Rather than a front bent lip 130 portion, the front of the plate 114 may instead include a partial funnel, spout, or gathering area like that of a pitcher, or any other mechanism that allows water to flow off the plate and towards the front opening 106. The interior piece 114 can be mounted on one or more support posts 124 located on the base 102 in between the base opening 120 and the cover's front opening 106. In other embodiments, these support posts may be fastened to the cover rather than the base. While in other embodiments, the posts may be fastened to the side walls. Though it seems that liquids should flow away from the front opening 106, one should recognize that the unit may be mounted such that the cover 110 is nearly level and the base 102 is slanted, rather than the orientation shown in FIG. 2, or such that the entire unit is slanted such that the front of the base 102 is lower than the portion opposite the front. It should be noted that FIG. 2 shows the interior plate 114 as a dotted line, as it may not be visible through the side wall 112.

The cover's curved lip 118 at the top of the front opening reduces the possibility of leakage or contaminant/liquid entrance through the front opening, as it reduces the size of the opening and directs water from over the cover 110 away from the opening 106.

In other embodiments, as shown in FIGS. 1 and 4, a rectangular strip 104 with at least one drainage hole 126 can be included at the bottom of the front opening 106 running at least partially across the base 102 from one sloped side wall 112 to the other sloped side wall 112. This strip 104 may extend across the whole front opening 106 or only a portion thereof. In some embodiments, the strip 104 may secure the mesh or front cover 108 in place. The drainage holes 126 in the strip 104 allow water guided by the interior piece 114 to drain out of the front of the vent 100 and down the roof. In some configurations, this strip may also have a top lip portion over the area where the drainage holes are.

In an exemplary configuration, air would flow from the base opening 120 out of the front opening 106 or around the interior plate 114 and out of the front opening 106 and louver(s) 116, or in the opposite direction. Moisture, water or other contaminants would fall through the louver(s) 116 onto the interior plate 114 and flow towards the front opening 106 and out of the vent 100. The raised portions 122 of the base 102 also prevent any liquid or other contaminants that fall onto the base 102 from flowing out of the base opening 120.

The vent's 100 components can be constructed out of any suitable materials. The components of the preferred embodiment will be made from sheet metal or other metallic material. Other materials known in the art, such as plastics or other suitable materials, may also be used.

In some embodiments, shingles or other roofing materials may be attached to the top of the vent 100 to blend it in to the roof surface. Shingles should not be placed in a position that would substantially block air flow to the exterior louver(s).

All components can be connected together using methods known in the art. The preferred method will include spot welding the components together. Other examples include the use of rivets, or a clinching (TALOC) machine, adhesives, screws, tabs, tension connections, or other similar equipment to bind the components together.

The raised edges 122 of the base opening can help regulate air flow and prevent leakage. They can comprise a lip 122 which rises upward toward the cover 110 around the edge of the opening 120. The raised opening edges 122 can comprise the material of the base 102 bent upwards or it can be a separate piece, of the same or other material, attached to the base 102.

A method for venting a roof is provided which comprises preparing an opening of a size slightly larger than the roof vent's base opening in a roof surface and providing a roof vent in the roof opening which contains a base with an opening for air inlet/outlet. The base opening may have raised edges and will be connected to a cover over the base opening including at least one exterior louver for air flow and a front opening. The vent may have sloped side walls to connect the base and cover. The front edge of the top of the cover has a lip curving down over the front opening to help prevent leakage. In some embodiments, the base of the roof vent should be positioned flush with the roof and then the roof vent should be permanently fixed in place.

One embodiment will be a Low Profile Roof Dormer Sheet Metal Vent comprising a base with an opening for air inlet/outlet, wherein said base opening has raised edges, connected to a cover over the base opening including at least one exterior louver for air flow and a front opening, an interior piece between the cover and the base opening to help reduce leakage, wherein the interior piece is sloped, being higher near the front opening and lowering down to end where the cover meets the base, and sloped side walls connecting the base and cover, wherein the front edge of the top of the cover has a lip curving down over the front opening.

Though the present disclosure discusses the vent being placed on a roof or attic, it should be understood that the vent may be placed on any structure or in any area which may require ventilation. This may include between floors within a structure, on a shipping container, or any other location which would allow for mounting of such a vent and where ventilation may be desired.

Although the present invention has been described in detail with reference to certain preferred configurations thereof, other versions are possible. The invention can be utilized in any installation where it would be proper. A person skilled in the art may make many variations and modifications to the disclosed embodiments utilizing functionally equivalent elements to those described herein. Any and all such variations or modifications as well as others which may become apparent to those skilled in the art are intended to be included within the scope of the invention as defined by the appended claims. Therefore, the spirit and scope of the invention should not be limited to the versions described above.

I claim:

1. A roof vent, comprising:

a base with a base opening;

a cover over said base opening, the cover connected to the base by sloped side walls, the cover including at least one louver;

an interior plate positioned between the base opening and the cover; and wherein the interior plate includes at least two side edges on the portions of the interior plate nearest the side walls, such that at least a portion of each of the at least two side edges have a raised portion, wherein said raised portions extend toward said cover;

wherein the base, the cover, and the sidewalls are positioned such that they create a front opening;

wherein the interior plate is mounted at an angle in relation to the base; and wherein said at least one louver is over said base opening, wherein a line extended in a direction from said base toward said cover and normal to said base, such that said line extends through said base opening, said line would travel through said base opening, said interior plate, and said at least one louver.

2. The roof vent of claim 1, wherein the at least one louver of the cover is positioned on said cover such that it is at least partially over the base opening and the interior plate.

3. The roof vent of claim 1, wherein the cover has a lip angled toward the base.

4. The roof vent of claim 1, further comprising a mesh cover at least partially covering the front opening.

5. The roof vent of claim 4, wherein a portion of said front opening includes a front strip adjacent to said base, in which the front strip includes at least one drain hole, wherein the front strip secures the mesh cover.

6. The roof vent of claim 1, wherein at least a portion of the edges of the base opening include a raised edge.

7. The roof vent of claim 1, wherein the interior plate includes a front edge on a portion of the interior plate nearest the front opening, such that at least a portion of the front edge has a lip angled toward the base.

8. The roof vent of claim 1, wherein a portion of said front opening includes a front strip adjacent to said base, such that the front strip includes at least one drain hole.

9. The roof vent of claim 1, wherein the interior plate is held by at least a post connected to said base.

10. The roof vent of claim 1, wherein the interior plate is held by at least a post connected to said cover.

11. The roof vent of claim 1, wherein the cover is mounted at an angle in relation to the base.

12. The roof vent of claim 1, wherein the cover includes at least 2 louvers.

13. A roof vent, comprising:

a base with a base opening, the base including raised features along the base opening to reduce liquid flow from the base through base opening;

a cover over said base opening, the cover connected to the base by sloped side walls, the cover including at least one louver positioned at least in part over the base opening, wherein the base, the cover and the side walls are positioned such that a front opening is created;

an interior plate positioned between the base opening and the cover, the interior plate including flow features to guide liquid flow toward the front opening, wherein the interior plate includes at least two side edges on the portions of the interior plate nearest the side walls, such that at least a portion of each of the at least two side edges have a raised portion, wherein said raised portions extend toward said cover;

wherein the base, the cover, and the sidewalls are positioned such that they create a front opening;

wherein the interior plate is mounted at an angle in relation to the base; and wherein said at least one louver is over said base opening, wherein a line extended in a direction from said base toward said cover and normal to said base, such that said line extends through said base opening, said line would travel through said base opening, said interior plate, and said at least one louver.

14. The roof vent of claim 13, wherein the cover has a lip angled toward the base.

15. The roof vent of claim 13, wherein the raised features along the base opening include a raised edge.

16. The roof vent of claim 13, wherein the flow features of the interior plate include at least two side edges on the portions of the interior plate nearest the side walls, such that at least a portion of the at least two side edges have a raised portion, the flow features further comprising a front edge on a portion of the interior plate nearest the front opening, such that at least a portion of the front edge has a lip angled toward the base.

* * * * *